US011702881B2

(12) United States Patent
Shahzad et al.

(10) Patent No.: US 11,702,881 B2
(45) Date of Patent: Jul. 18, 2023

(54) LIGATURE SAFE DOOR

(71) Applicants: Abdullah Shahzad, Aurora, IL (US); Benjamin Zeeb, Oswego, IL (US)

(72) Inventors: Abdullah Shahzad, Aurora, IL (US); Benjamin Zeeb, Oswego, IL (US)

(73) Assignee: Norix Group, Inc., West Chicago, IL (US)

( * ) Notice: Subject to any disclaimer, the term of this patent is extended or adjusted under 35 U.S.C. 154(b) by 543 days.

(21) Appl. No.: 16/795,572

(22) Filed: Feb. 19, 2020

(65) Prior Publication Data

US 2021/0254393 A1 Aug. 19, 2021

(51) Int. Cl.

| | |
|---|---|
| ***E05G 1/026*** | (2006.01) |
| ***E06B 5/16*** | (2006.01) |
| ***E05C 19/16*** | (2006.01) |
| ***E06B 5/10*** | (2006.01) |
| ***E05D 1/00*** | (2006.01) |
| ***E05B 15/16*** | (2006.01) |
| ***E05D 7/00*** | (2006.01) |
| ***E05D 7/12*** | (2006.01) |

(52) U.S. Cl.

CPC ..... *E05G 1/026* (2013.01); *E05B 15/16* (2013.01); *E05C 19/16* (2013.01); *E05D 1/00* (2013.01); *E05D 7/009* (2013.01); *E05D 7/12* (2013.01); *E06B 5/10* (2013.01); *E06B 5/16* (2013.01); *E05Y 2900/132* (2013.01)

(58) Field of Classification Search

CPC ... Y10T 70/7057; Y10T 292/11; E05G 1/026; E05G 1/02; E05G 1/04; E05D 7/14; E05D 1/00; E05D 7/009; E05D 7/12; E06B 5/10; E06B 5/16; E05B 1/0053; E05B 1/0061; E05B 15/16; E05C 19/16

USPC ..... 49/141, 394, 395; 109/64, 76, 80–85

See application file for complete search history.

(56) References Cited

U.S. PATENT DOCUMENTS

| | | | | | |
|---|---|---|---|---|---|
| 1,564,205 | A | * | 12/1925 | Clark | E05G 1/024 217/17 |
| 2,492,422 | A | * | 12/1949 | Govan | E05G 1/024 52/261 |
| 2,512,711 | A | * | 6/1950 | Bremer | E05G 1/024 109/69 |
| 3,408,966 | A | * | 11/1968 | Gartner | E05G 1/024 109/74 |
| 3,451,706 | A | * | 6/1969 | Baermann | E05C 19/16 292/251.5 |
| 3,730,577 | A | * | 5/1973 | Shanok | E05C 19/16 49/394 |

(Continued)

*Primary Examiner* — Christopher J Boswell
(74) *Attorney, Agent, or Firm* — James D Palmatier; Applied Patent Services, PC

(57) ABSTRACT

The safe door is a releasable door comprising a fire resistant body attached to a door jamb to provide privacy. Safe door comprises a frame less door panel attached to a door jamb by magnets engineered to release when a breakaway force is applied to the door in any direction. Safe door is assembled with welding and adhesive of a foam core, a fire sock and a protective sheet inside a cover of vinyl sheeting. The fire sock and cover are closed to prevent moisture penetration or disassembly to protect people and property. A handle on a handle side and a hinge on a hinge side attach where a traditional door may attach to allow door to move from an open position to a closed position.

14 Claims, 2 Drawing Sheets

(56) References Cited

U.S. PATENT DOCUMENTS

| | | | | |
|---|---|---|---|---|
| 3,749,301 | A * | 7/1973 | Peckar | B65D 5/6673 229/125.37 |
| 3,827,019 | A * | 7/1974 | Serbu | A41F 1/002 135/117 |
| 4,434,524 | A * | 3/1984 | Gilchrist | E05F 15/60 16/280 |
| 6,253,826 | B1 * | 7/2001 | Witter | E06B 3/481 160/DIG. 16 |
| 7,657,971 | B2 * | 2/2010 | Danko | E05D 1/00 220/230 |
| 2008/0122324 | A1 * | 5/2008 | Bienick | F25D 23/02 49/501 |
| 2009/0293364 | A1 | 12/2009 | Garstad et al. | |
| 2015/0218862 | A1 * | 8/2015 | Day | E05B 17/002 292/251.5 |
| 2016/0153219 | A1 * | 6/2016 | Sanders | E05C 19/161 292/251.5 |
| 2020/0206014 | A1 * | 7/2020 | Richardson | A47B 97/00 |
| 2021/0127832 | A1 * | 5/2021 | Shahzad | A47B 97/00 |

* cited by examiner 32
14
38
20
12
10
18
36
50
52
48
22
13
44
10 F
34
46
24

20
10
14
20
18
20
12
32
34
46
22
50
36
14
18
44
22
38
26

16
30
24
26

LIGATURE SAFE DOOR

FIELD OF THE INVENTION

The LIGATURE SAFE DOOR relates to doors designed to provide privacy while eliminating the door as a weapon or ligature support for use in applications such as health care and hospitality facilities.

BACKGROUND OF THE INVENTION

Safe Door is designed as an intensive use furniture piece designed for use in demanding environments. Facilities housing individuals for recreation or rehabilitation from health or legal problems require comfortable aesthetically pleasing furniture for safely furnishing living quarters. Movable furniture, exposed fasteners for assembly and attachment to floor or wall and ligature tie offs may be used to cause harm to visitors, property or guests. The furniture must be designed to function while not presenting any danger to people or property. Doors are typically designed to provide a level of security having a rigid plane fixed to the building and usually having a latch or lock mechanism that will hold the door closed.

Doors by their prior art design present a danger of ligature by providing a tie off at the intersection of the building, hinge and door. Doors are used in every facility built or modified to shelter guests for any reason. Prior art such as the Soft Suicide Door disclosed by Garstad et al. In US Publication No. 2009/0293364 A1 allegedly disclose a door capable of releasably attaching to a door frame to avoid the use as a ligature point. The prior art doors ignore the other requirement of such intensive use furniture, namely fire and safety tests from such agencies as ASTM, NFPA, Ca., and others. The prior art doors offer the opportunity to use the frame as a weapon.

Therefore, it is desirable to provide safe door that can further protect people and property with aesthetically pleasing characteristics and design for comfortable use. Therefore there is a need to provide an intensive use furniture product without exposed fasteners and designed for concealed, releasable attachment to a mounting surface such as a door frame.

BRIEF DESCRIPTION OF THE PRESENT INVENTION

The Fire Resistant Safe Door is an Intensive Use Furniture piece comprising a frameless structure. The frameless structure is adapted to provide a low profile while providing privacy, protection from fire and airborne objects. The Safe Door comprises a body, a hinge, a handle and a latch. The body may comprise an internal panel of foam such as an expanded polyethylene providing structural stiffness to remain positioned as a door offering privacy. The panel is thick enough to fill a door cavity while avoiding gaps or bulges. The panel is sealed inside a fire sock by welding and gluing the fire sock about the panel. Fire sock isolates the foam panel. Fire sock enclosed foam panel is disposed inside a vinyl cover. The vinyl cover is wrapped from a latch side to a hinge side. Seams at the top and bottom are welded to resist seam ripping. Seam at hinge side forms living hinge extending from hinge side.

Hinge may comprise living hinge wrapped with webbing such as nylon webbing having a plurality of magnets disposed at regular intervals from top to bottom adjacent to hinge side of body. The magnets may comprise a pull strength of approximately 27 pounds each. Web is sewn to living hinge securing magnets in place. Handle is provided on one or both side of body on latch side to assist moving the door from an open position to a closed position. The handle comprises a reinforcing strip of a material similar to the cover disposed between the fire sock and the cover. The reinforcing strip may be attached to the fire sock or to the inside of the cover adjacent latch position. Handle may comprise nylon web attached to cover outside thereby sandwiching cover between nylon web and reinforcing strip. Handle may comprise a folded tab in nylon web. Folded tab may be welded or glued portion of nylon web extending generally perpendicular to panel. Fire resistant safe door may further comprise a second handle formed on the opposite side of panel. Latch may comprise a magnet enclosed in a closed fold of nylon web disposed adjacent to latch side of body.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable.

Figures 1, 2, 3:
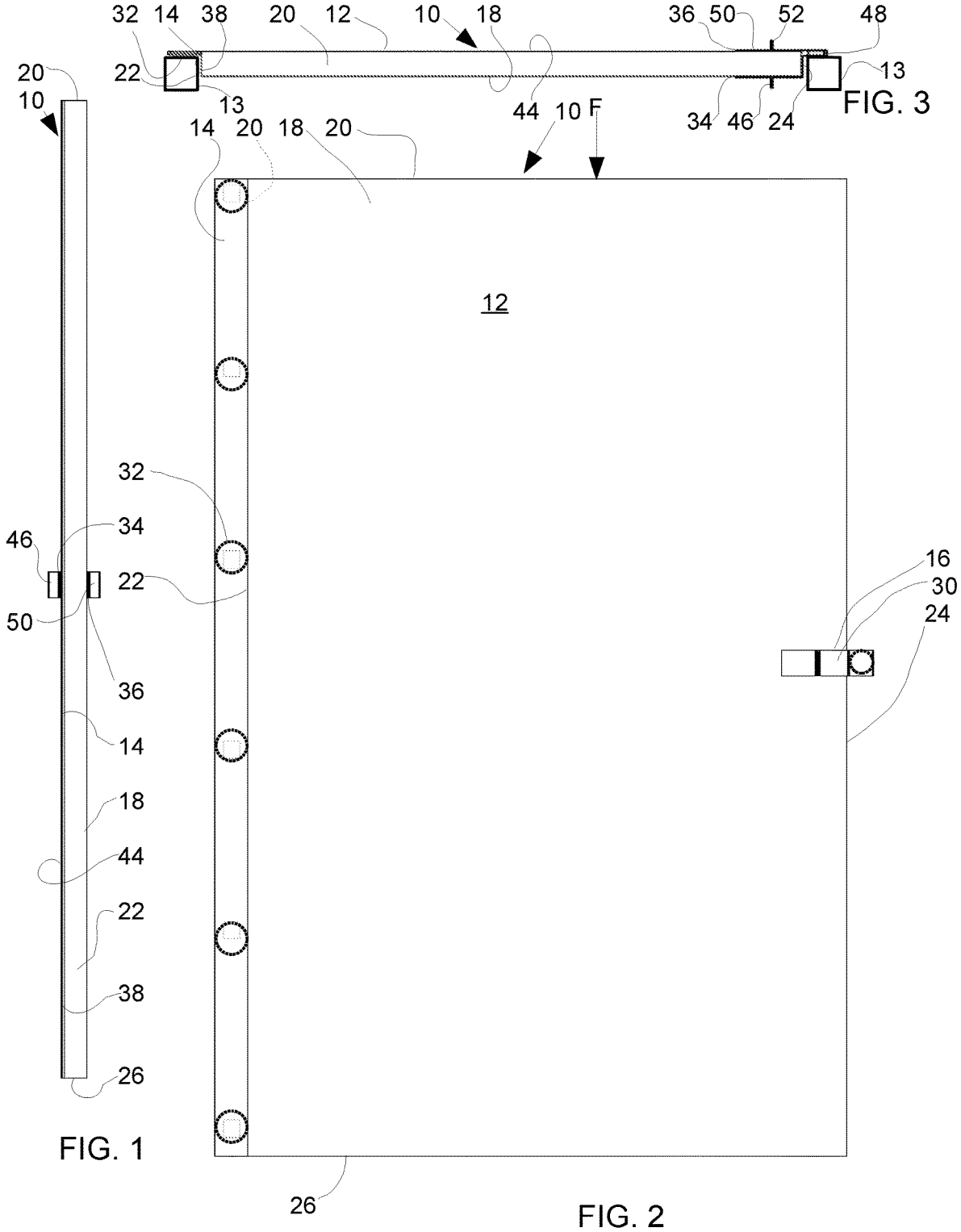
FIG. 1 is a hinge side elevation view of the safe door.
FIG. 2 is a front plan view thereof.
FIG. 3 is a top plan view thereof.

Referring to FIG. 1, a safe door 10 may comprise a body 12, hinge 14 and latch. 16. Body 12 may comprise a door front 18, door top 20, hinge side 22, latch side 24 and door bottom 26. Hinge 14 may be disposed on hinge side 22 attached to body 12. Latch 16 may be disposed on latch side 24 attached to body 12 spaced from hinge 14. Hinge 14 may further comprise releasable connector 32.

Referring to FIG. 2, body 12 may comprise back side 44. Hinge 14 may be connected to body 12 generally aligned disposed as an extension of back side 44. Latch 16 may further comprise a back end 34 and a front end 36. Hinge 14 may extend from door top 20 to door bottom 26. Breakaway force F may be calculated to overcome releasable connector 32.

Referring to FIG. 3, safe door 10 may comprise a planar shaped body 12 attached to hinge 14 and latch 16. Hinge 14 may be disposed extending from back side 44 to door front side 18. Latch 16 may comprise web 50, such as nylon web used for automotive seat belts, extending from back end 34 on door back 44 to front end 36 disposed on door front 18. Web 50 is disposed on body 12 surrounding latch side 24 having front handle tab 46, latch tab 48 and back handle tab 52. Hinge 14 may be adapted to releasably attach to door jamb 13 by magnets or hook and loop fasteners. Hinge 14 may be adapted to release from door jamb when a breakaway force F (FIG. 2) is applied to door body 12 of a predetermined weight, such as 20 pounds, calculated to prevent the door 10 from being used as a ligature tie off.

Figure 4:
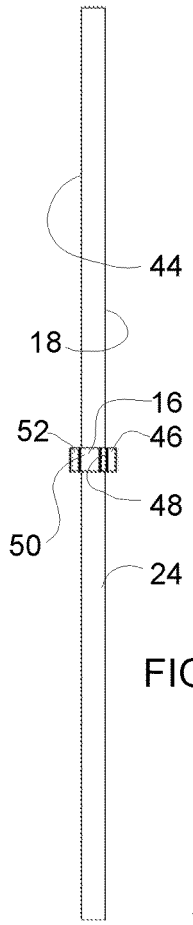
FIG. 4 is a latch side elevation view thereof.
Figure 5:
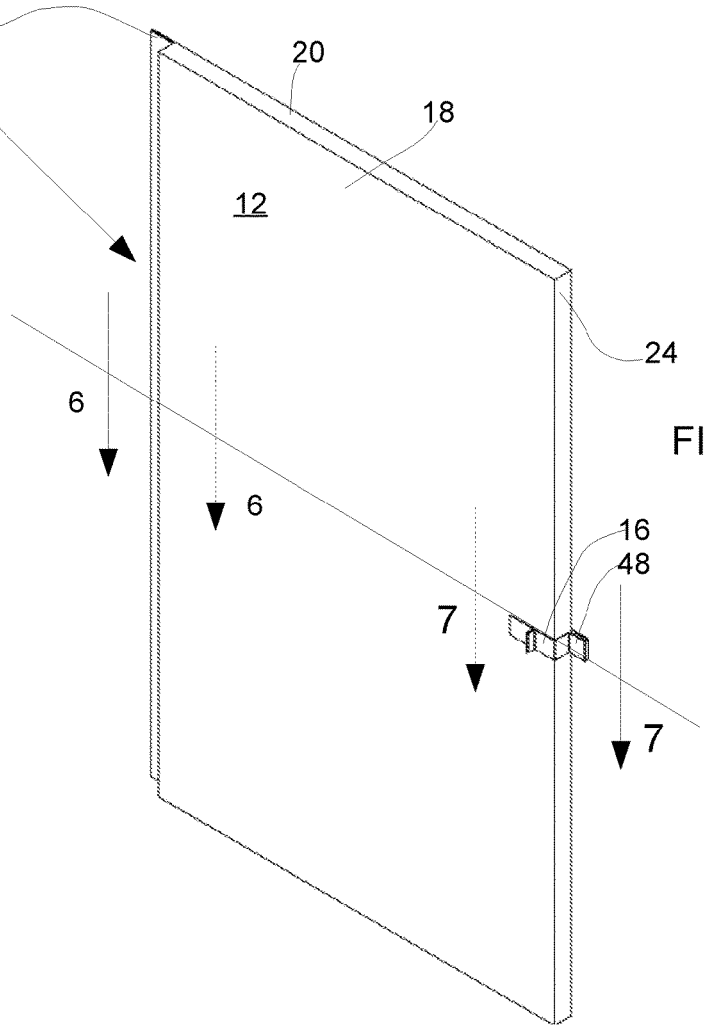
FIG. 5 is a top front elevation view thereof.

Referring to FIGS. 4 and 5, safe door 10 may comprise web 50 may extend from door front 18 to door back 44. First handle tab 46 extends from door front 18.

Figure 6:
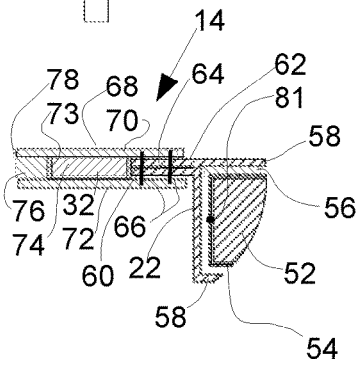
FIG. 6 is a section view taken at approximately 6-6 of FIG. 5.

Referring to FIG. 6, door 10 may comprise body 12 having hinge 14 attached. Body 12 may comprise foam core 52 having a one piece planar sheet. Foam core 52 may comprise a foamed material such as an 1.5 inch sheet of expanded polyethylene having a density adapted to be bendable without creasing. Foam core 52 may be enclosed by fire sock 54. Fire sock 54 may comprise sheet of fire proof material wrapped around foam core 52 on all sides having seams closed by welding, stitching or adhesive. Body 12 may further comprise protective sheet 56. Protective sheet 56 may comprise Kevlar® having bullet resistant properties or similar material disposed on top of fire sock 54.

Continuing to refer to FIG. 6, outside cover 58 may comprise a polyethylene vinyl flexible sheet wrapped around fire sock 54 and foam core 52. Outside cover 58 may comprise a sheet of puncture resistant vinyl material on fire sock having seams closed by welding or adhesive to seal fire sock wrapped foam core 52 inside outside cover 58. Outside cover 58 may form living hinge 64 along body hinge side 22. Living hinge 64 may comprise front cover tab 60 and back cover tab 62. Front cover tab 60 and back cover tab 62 may be welded together to seal outside cover 58 around foam core 52. Hinge cover 68 may comprise a front hinge cover 70 and back hinge cover 72 formed of nylon web material. Living hinge 64 may comprise stitching 66 to attach hinge cover 68 to living hinge 64. Releasable connector 32 may further comprise magnet 74 disposed between front hinge cover 70 and back hinge cover 72. Front cover tab 60 and back cover tab 62 may be attached by adhesive, welding or stitching 76 on outside edge 78 of hinge cover 68. The magnet 74 may be disposed on in magnet pockets 73 formed between front hinge cover 70 and back hinge cover 72. The fire sock 54 may comprise welded seams 81 around foam core 52.

Figure 7:
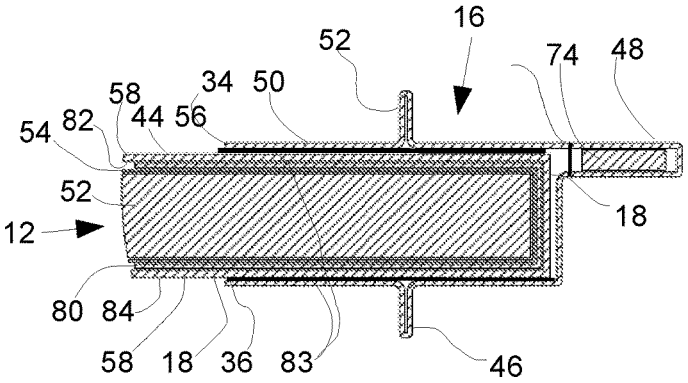
FIG. 7 is a section view taken at approximately 7-7 of FIG. 5.

Referring to FIG. 7, latch 16 may further comprise reinforcement sheet 80 disposed on fire sock 54 and surrounded by outside cover 58. Reinforcement sheet 80 may be attached to outside cover inside 82 where by outside cover 58 is sandwiched between reinforcement sheet 80 and latch 16. Reinforcement sheet 80 may further wrap around latch side 24 and extend toward hinge side 22 adjacent front side 18 and back side 44. Latch 16 is attached to reinforcement sheet 80, through outside cover 58, by adhesive 83, stitching or welding. Latch web 50 may be attached to cover outside 84 adjacent to reinforcement sheet 80. Front handle 46 may comprise a folded portion of latch web 50 extending from outside cover 58 in a generally perpendicular orientation to cover front 18. Back handle 52 may comprise a folded portion of latch web 50 extending from outside cover 58 in a generally perpendicular orientation to cover back 44. Latch tab 48 may comprise a folded portion of latch web 50 extending from outside cover 58 in a generally perpendicular orientation to latch side 24. Magnet 74 may be disposed in latch tab 48. Magnet 74 may be in folded portion of latch web 50.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

The invention claimed is:

1. A safe door for attaching to a door jamb, the safe door comprising a frameless body, the frameless body comprising door top, a door front, a door back, a hinge side and a latch side the frameless body further comprising a foam core, a fire sock and a outside cover, the foam core inside the fire sock, the fire sock inside the outside cover;

a hinge on the hinge side, the hinge comprising a front hinge cover, a back hinge cover, and a plurality of magnets, the front hinge cover on the outside cover, the hinge spaced from the fire sock, the plurality of magnets spaced from the frameless body, the plurality of magnets disposed between the front hinge cover and the back hinge cover;

a latch on the latch side, the latch comprising a latch web on the door front, the latch web extending around the latch side to the door back, the latch web on the outside cover, a first handle on the latch, a latch tab on the latch, the latch tab comprising a magnet, the magnet attached to the frameless body.

2. The safe door of claim 1, further comprising a living hinge on the frameless body, the living hinge on the hinge side, the living hinge on the front hinge cover.

3. The safe door of claim 1, further comprising a protective layer, the protective layer disposed between the fire sock and the outside cover.

4. The safe door of claim 3, wherein the protective layer is bullet resistant.

5. The safe door of claim 1, further comprising a second handle on the door back, the second door handle attached to the outside cover, the second door handle attached to the first door handle.

6. The safe door of claim 1, further comprising a reinforcing layer on the latch, the outside cover further comprising a cover inside, the reinforcing layer on the cover inside, the outside cover sandwiched between the latch and the reinforcing layer.

7. The safe door of claim 6, further comprising a welded seam living hinge on the frameless body, the living hinge on the hinge side, the living hinge on the front hinge cover.

8. The safe door of claim 7, further comprising a protective layer, the protective layer disposed between the fire sock and the outside cover.

9. The safe door of claim 8, wherein the protective layer is bullet resistant.

10. The safe door of claim 1, further comprising a second handle, the second handle on the body.

11. The safe door of claim 1, wherein the fire sock separates the foam core from the outside cover.

12. A safe door for attaching to a door jamb, the safe door comprising:

a frameless body, the frameless body comprising door top, a door front, a door back, a hinge side and a latch side the frameless body further comprising a foam core, a fire sock and a outside cover, the foam core inside the fire sock, the fire sock inside the outside cover, a living hinge on the outside cover;

a hinge, the hinge comprising a living hinge, the living hinge comprising a front hinge cover, a back hinge cover, and a plurality of magnets, the front hinge cover on the living hinge, the back hinge cover on the living hinge, the plurality of magnets spaced from the frameless body, the plurality of magnets disposed between the front hinge cover and the back hinge cover; and a latch on the latch side, the latch comprising reinforcing layer, a magnet, a latch web, a first handle, a second handle and a latch tab, the reinforcing layer on the outside cover, the outside cover sandwiched between the latch web and the reinforcing layer, the first handle on the door front, the second handle on the door back, the latch tab on the latch side, the latch web on the door front, the latch web on the door back, the latch web on the latch side, the first handle comprising a folded tab of the latch web extending from the door front, the latch tab comprising a magnet attached to the latch web, the magnet attached to and spaced from the frameless body.

13. The safe door of claim 12, further comprising a protective layer, the protective layer disposed between the fire sock and the outside cover.

14. The safe door of claim 13, wherein the protective layer is bullet resistant.

* * * * *